United States Patent [19]

Piteo

[11] 4,403,593

[45] Sep. 13, 1983

[54] ELECTRONIC SWITCHING FOR SOLID STATE IGNITION

[75] Inventor: Michael J. Piteo, Enfield, Conn.

[73] Assignee: R. E. Phelon Company, Incorporated, East Longmeadow, Mass.

[21] Appl. No.: 344,609

[22] Filed: Feb. 1, 1982

[51] Int. Cl.[3] ..... F02P 1/08

[52] U.S. Cl. ..... 123/651; 123/149 C

[58] Field of Search ..... 123/149 C, 149 D, 149 R, 123/599, 602, 651, 652, 418, 605

[56] References Cited

U.S. PATENT DOCUMENTS 4,174,697 11/1979 Podrapsky et al. ..... 123/149 C X
4,178,892 12/1979 Podrapsky et al. ..... 123/149 C X
4,188,929 2/1980 Podrapsky et al. ..... 123/602 X
4,207,852 6/1980 Ohki et al. ..... 123/149 C X
4,233,951 11/1980 Take ..... 123/149 C X
4,329,950 5/1982 Orova et al. ..... 123/605 X

*Primary Examiner*—Tony M. Argenbright
*Attorney, Agent, or Firm*—Chapin, Neal & Dempsey

[57] ABSTRACT

Breakerless ignition system of the inductive type is used to provide ignition pulses for an internal combustion engine which substantially duplicates the timing performance of a breaker-point magneto. The system utilizes a transistor for making and breaking the current flow in the primary coil of the ignition transformer. Switching of the transistor is controlled by a silicon controlled rectifier (SCR) and gating of the SCR is controlled by a time-delay network which includes a capacitor, resistor and a transistor switching means in circuit with the control electrode of the SCR. A second transistor and capacitor network controls the rate of rise of current to the time-delay network as a function of engine speed.

6 Claims, 4 Drawing Figures

ELECTRONIC SWITCHING FOR SOLID STATE IGNITION

BACKGROUND OF THE INVENTION

As is common to all breakerless ignition systems of the inductive type, an electronic switch means is provided which allows current to flow in a primary winding and thereafter at a predetermined time an ignition pulse is generated by interrupting the primary current flow. The current interruption results in a sharp collapse of the magnetic field linking the primary coil and thereby an ignition voltage is induced in the secondary winding.

In breaker-point magnetos, the ignition pulse occurs at the same rotational position of the flywheel throughout the speed range. The cam is located so that the points will interrupt the primary current flow at a point along the descending side of the current pulse at low rpm and as the engine speed increases, the ignition point gradually shifts toward the peak of the pulse and thereafter occurs along the ascending side of the pulse. Under the present state of the breakerless ignition art, no means are available for interrupting the primary current flow on the descending slope of the current pulse generated at low rpm in the primary. The triggering of the solid state switching systems invariably takes place at the peak or ascending slope of the primary current and, at increased speeds, the output voltages will consequently be of decreasing value.

Applicant is unaware of any solid state ignition systems which duplicate the ignition timing performance of a breaker-point magneto.

The principal object of this invention is to provide an inductive breakerless ignition system which produces ignition pulses having a timing stability essentially equivalent to that achieved by a breaker-point magneto.

Another object of this invention is to provide an ignition system of the above type having superior timing stability in comparison to breakerless ignition systems heretofore available.

A further object of this invention is to provide a breakerless ignition system of the inductive type wherein the ignition pulse at various engine speeds occurs at essentially the same position of the rotating magnetic field.

The above and other objects and advantages of this invention will be more readily apparent from the following description and with reference to the various drawings accompanying this description.

DETAILED DESCRIPTION OF THE DRAWINGS

Figure 1:
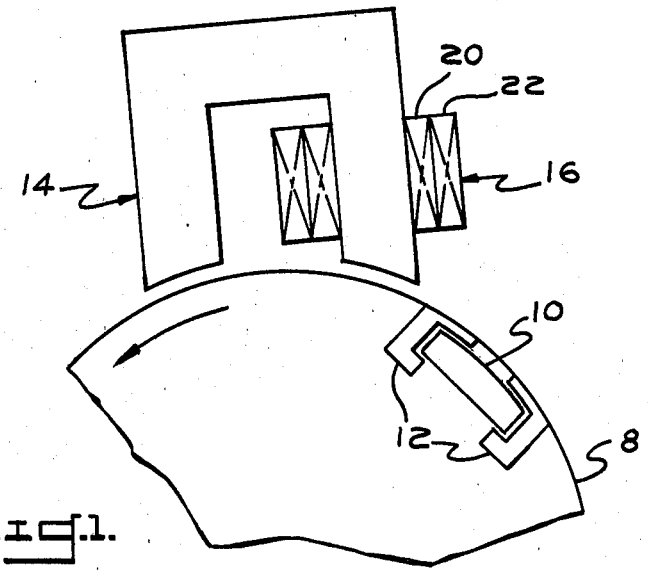
FIG. 1 is an elevational view of a magnetomotive device of the type embodying this invention.

In FIG. 1 is shown a magnetomotive device comprising a rotating magnetic field in the form of a flywheel 8 carrying in its rim a permanent magnet 10 and a pair of pole shoes 12. The stator of the magnetomotive device, as shown, includes a ferromagnetic core 14 of U-shaped configuration which provides a flux path for the magnetic lines of flux emanating from the magnetic poles 12.

A transformer ignition coil 16 is disposed on the leading leg portion of the core 14 and includes primary coil 20 and secondary coil 22.

As the magnetic poles carried by the flywheel 8 rotate past the core 14, magnetic flux provided by the poles induces a voltage in the primary coil 20 of the transformer 16. Timing for convention magnetos which utilize mechanical breaker-points is set to obtain maximum ignition voltages at all speeds. This is accomplished by a breaker assembly (not shown) which, at low rpm, interrupts primary current at some point after peak value. As the speed of the engine increases, ignition pulses occur closer to the peak value of primary current and at yet higher rpm shift onto the ascending side of the current pulse. The significant feature of these mechanical breaker-point systems is that throughout the speed range of the engine, ignition occurs at the same flywheel position relative to the core.

Figure 2:
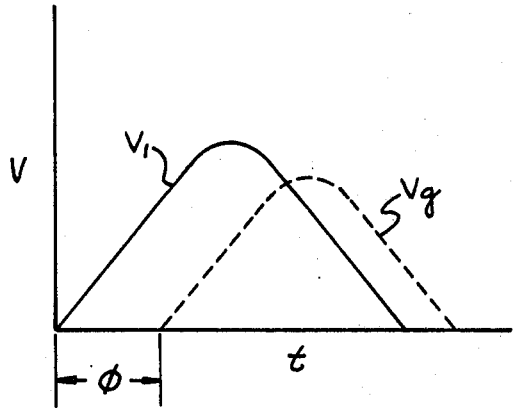
FIGS. 2 and 3 are diagrams showing electrical pulses generated at various operational speeds of an ignition system embodying this invention.
Figure 4:
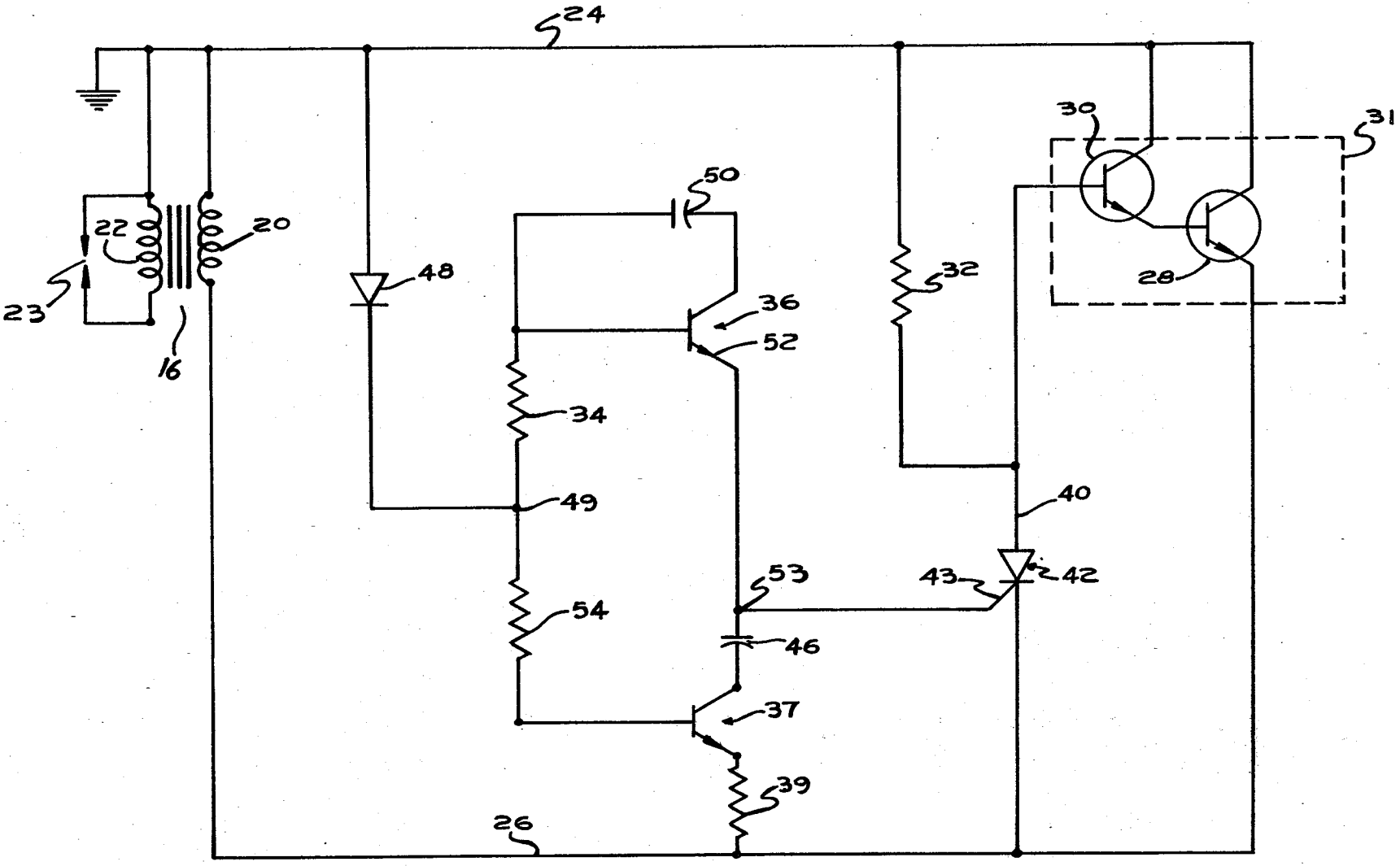
FIG. 4 is a schematic wiring diagram of one type of inductive breakerless ignition system embodying this invention.

Illustrated in FIG. 2 are sinusoidal input and output voltages $V_1$ and $V_g$, respectively, which are generated in the control circuit illustrated in FIG. 4. As illustrated, the output signal starts at some predetermined time (t) later than the input signal, that is it lags the input by phase angle $\phi$.

Figure 3:
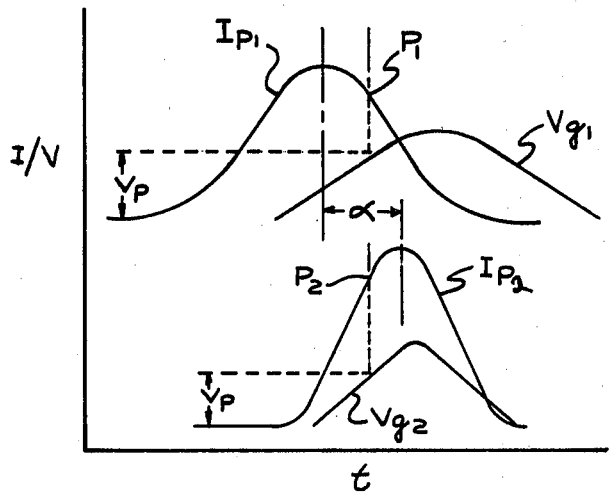

In FIG. 3 are illustrated primary current ignition pusles $Ip_1$ and $Ip_2$, voltage pulses $Vg_1$ and $Vg_2$ at two different engine speeds. Pulse $Ip_1$ represents the primary curent at low rpm, while the primary current pulse $Ip_2$ is shown at high rpm of the same engine. Voltages Vg are the voltages seen by the control electrode 43 of SCR 42 (FIG. 4). The SCR will turn "ON" at its designed breakdown voltage, shown as Vp in FIG. 3. It should be recognized that the ignition point $P_1$ in FIG. 3, at low rpm, is located on the descending slope of the primary current pulse, and as the engine speed increases, the ignition point $P_2$ has shifted onto the ascending side of the ignition pulse. Thus, the ignition point at low rpm occurs on the descending side of the ignition pulse, gradually shifts toward the peak of the pulse and then occurs on the ascending side, as with a breaker point magneto.

It is the purpose of this invention to provide a solid state inductive ignition system wherein the electronic components are so combined and interconnected as to cause the system to provide ignition pulses at a fixed position in relation to the rotation of the magnetic field relative to the coil. In other words, as the inductive lag $\alpha$ increases, with increased rpm, the phase angle $\phi$ is caused to decrease commensurately, whereby the ignition point will occur at the same edge distance over the range of operating speeds of the system.

In the circuit diagram in FIG. 4, a breakerless ignition is shown for use on an internal combustion engine whereby the ignition point at various engine speeds is fixed in relation to flywheel position (edge distance) in the same manner as a breaker-point magneto ignition system.

Transformer ignition coil 16 comprises primary winding or coil 20 and a secondary winding or coil 22 with a spark gap device 23 connected across the secondary to provide an ignition pulse for an internal combustion engine of any suitable type such as may be used on lawnmowers, outboard engines and the like.

The primary coil 20 is connected by circuit means including leads 24 and 26 through the collector/emitter electrodes of transistor 28 which, in combination with transistor 30, forms a Darlington amplifier 31. When transistor 28 is in its low impedance state, a primary current path or loop is provided from coil 20 by leads 24 and 26 and transistor 28. A second path for a small portion of the primary current is connected across the primary coil and comprises diode 48 and a voltage divider network including resistors 34 and 54, in combination with switching transistors 36 and 37 which, in the embodiment shown, are preferably the NPN types. Transistor 36 has its emitter 52 connected to junction 53, which is connected to the control electrode 43 of SCR 42 and capacitor 46. Connected across the base and collector electrodes of transistor 36 is a second capacitor 50. Transistor 36 and capcitor 50 of this circuit provide an input circuit which controls the rate of curent flow to transistor 37. Capacitor 46, transistor 37 and resistor 39 provide the output branch of this circuit.

Transistor 37 has its emitter connected to lead 26 through resistor 39, and its collector electrode connected to the capacitor 46. Another resistor 32 interconnects lead 24 to lead 40 which, in turn, electrically connects the base of transistor 30 to the anode of SCR 42. When SCR 42 is gated "on", it shunts primary current from the base of transistor 30, which in turn, cuts "off" transistor 28, thereby generating an ignition pulse.

In operation, when flux generating means such as permanent magnets are caused to move relative to ignition coil 16 whereby lines of magnetic flux are cut, a voltage is induced in the primary winding 20. As the voltage in coil 20 starts to rise, a small base/emitter current flows from coil 20 through lead 24, resistor 32, base/emitter electrodes of transistors 30 and 28 and lead 26. Transistor 30 is biased to its conductive state and, as a result, transistor 28 of the Darlington pair also becomes conductive. As a consequence, a primary loop for the current, generated in primary coil 20 is completed by lead 24, transistor 28 and lead 26.

As the current through the collector/emitter path of transistor 28 builds up, a small portion of primary current flows into a control circuit through diode 48 to junction 49 between resistors 34 and 54 of the current divider network whose resistance values are selected to cause the current pulses to follow two different paths. Diode 48 is polarized to pass positive current pulses and to block the negative pulses generated in the coil 20. The positive input voltage pulse is represented by $V_1$ in FIG. 2. From junction 49, portions of the current, depending upon the relative impedance of the two circuits, divides to follow a first path which includes resistor 54, the base/emitter electrodes of transistor 37, resistor 39 and lead 26 back to the primary coil 20. The current also follows a second path which includes resistor 34, transistor 36, when turned "ON", and capacitor 46.

By selecting the resistance value of resistor 34, a predetermined level of current is allowed to flow through transistor 36 toward capacitor 46. In addition, selection of the value of resistor 54, the transfer resistance of transistor 37, the values of resistor 39 and capacitor 46 are also selected to provide the requisite impedance in this output branch of the circuit at a given frequency for the desired phase angle. Transistor 37 is used for controlling the resistance portion of the impedance because it compensates for irregularities of the input signal passed by input transistor 36 and variations resulting from the tolerances in component values. Any sudden increase of the input signal would normally result in a higher current value at the output; however, since transistor 37 is driven by the same signal, it lowers the output impedance and the value of the output voltage remains constant.

By way of example, resistor 34 may have a value of about 1000 ohms and resistor 54 about 15,000 ohms so that only a small amount of current flows through the first circuit sufficient to turn "on" transistor 37. With a value of about 4.5uf, the capacitive reactance ($X_c$) of capacitor 46 in combination with the transfer resistance of transistor 37 and resistor 39 provides a total impedance which will cause SCR 42 to turn "ON" at the same "edge distance" over the range of engine speeds. Phase angle depends upon the rate of current flow through the R/C time delay network which includes capacitor 46, resistor 39 and transistor 37. These components provide a time constant, up to a certain frequency, such that the SCR 42 will be gated "on" at the selected edge distance. At low rpm, moreover, capacitive reactance $X_c$ of capacitor 46 is selected to form a resonant circuit with the inductive reactance $X_L$ of the primary coil 20. As a result, the impedance in this branch of the circuit within this frequency range approaches pure resistance consisting of resistor 39 and the resistance of transistor 37. This results in an output signal across SCR 42 which is in phase with the input signal. It is this combination of components and their selected values which results in fixed timing or ignition spark at a constant edge distance throughout the entire speed range of the magneto system. In other words, the reactance $X_c$ of capcitor 46 decreases at the same rate that the inductive reactance $X_L$ of the circuit increase with increased rpm, the result being, in a sense, a treadmill operation which serves to hold the firing point at a fixed edge distance.

The input branch of the control circuits includes a capacitor 50 having, for example, a capacitance of about 20uf connected from the base to the collector electrode of transistor 36. It will be noted that capacitor 50 has a capacitance of about five times the value of capacitor 46.

As the rpm of the magneto increases, the voltage level at the input branch of the control circuit increases, causing higher and higher current levels to flow through the output branch of this circuit. Simultaneously, with the increase in current, the resistance of transistor 37 decreases proportionately, whereby the resulting voltage output level remains generally constant. However, when the system gets to the higher rpm range, transistor 37 becomes more and more saturated until its resistance will decrease no further. This would normally result in an increased voltage drop in the output circuit, but is compensated for by the input branch, comprising transistor 36 and capacitor 50 connected across the collector and base electrodes of the transistor.

When transistor 36 is biased "ON", current is instantaneously delivered by the emitter electrode toward the output branch of the control circuit, and then the transistor 36 turns itself "OFF". It shuts "off" because as soon as it comes "ON", the base to emitter is shorted below its threshold level. Then, as soon as it shuts "OFF", the base to emitter is decoupled, and the base to emitter threshold voltage recovers, turning the transistor back "ON" in a repeating "ON-OFF" cycle. At lower frequencies, the transistor 36 conducts at a low rate, and the capacitive reactance Xc of capacitor 50 is relatively high, so the threshold is not shorted too deeply. This means that at low frequency operation, the transistor cycles "ON" and "OFF" very rapidly, while at higher frequencies, the "OFF" cycles are of longer duration, and even though the current pulses are of higher amplitude, the average output current transistor 36 is lower. The value of capacitor 50 is selected so that the output voltage pulse of the control circuit will occur at the same edge distance for high and low speed magneto operation.

When the voltage on capacitor 46 reaches a predetermined voltage level, the SCR 42 will be gated "on" resulting in the base current to transistor 30 being shunted through resistor 32, the anode/cathode path of SCR 42 to lead 26 and back to primary coil 20. When SCR 42 is triggered "on", transistor 28 of the Darlington pair is cut "off" with a consequent sudden collapse of current in primary coil 20 which induces an ignition voltage in secondary coil 22.

The system of FIG. 4 thus permits selection of a desired edge distance for a given phase angle at low rpm whereby that edge distance will remain the same over the range of speeds of the magnetomotive device. Moreover, as illustrated in FIG. 3, the pulses occur at points close to peak current and at low rpm, $P_1$ on the descending side of the current pulses and at high rpm $P_2$ occurs at the ascending side of the pulse in the same manner as a breaker point magneto.

Having thus disclosed my invention, what is claimed is:

1. In a breakerless ignition system for internal combustion engines having an ignition transformer including a primary coil associated with a rotating magnetic means for inducing current in the primary coil whose frequency is directly related to the engine rpm and in which said coil is connected into a primary current circuit containing an electronic switching means for making and breaking the circuit, a control circuit for actuating said switching means at a predetermined position of rotation of the magnetic means, said control circuit connected to receive a portion of the current from the primary circuit and including a capacitor for storing voltage which, at a predetermined level, causes actuation of said electronic switching means; said control circuit including an input branch for controlling the rate of charging of the capacitor as a function of the frequency of the current pulses generated in the primary coil whereby, as the engine rpm increases, the feed rate for charging said capacitor decreases.

2. In a breakerless ignition system, the control circuit set forth in claim 1 in which said capacitor is part of a resistance-capacitance time delay network, said resistance including a transistor, said input branch including a second capacitor and transistor connected to control the feed rate of the time delay network.

3. In a breakerless ignition system, in which the control circuit of claim 1 comprises two branches, one branch having a predetermined impedance and includes a transistor for connecting said capacitor in the control circuit, the input branch having a substantially lower impedance than said one branch so that proportionally more current pulses flow therein, said input branch including a second transistor with a second capacitor connected across its base and collector electrodes to control the amount of current flowing through the second transistor as a function of the change in capacitive reactance of said second capacitor, the output of said second transistor connected to charge said first named capacitor whereby the feed rate for charging the first capacitor will vary with change in frequency of the current pulses generated in the primary coil.

4. In a breakerless ignition system, a control circuit as set forth in claim 1, wherein a silicon controlled rectifier (SCR) having a gate electrode is connected across the primary current circuit for actuating said switching means, the gate electrode of said SCR being connected to receive a gating voltage from said capacitor, said capacitor forming part of a resistance-capacitance time delay network, the reactance of said capacitor being selected to provide a resonant circuit with the inductive reactance of said primary coil at low engine rpm.

5. A breakerless ignition system for internal combustion engines having an ignition transformer including a primary coil and a secondary coil mounted on a core which provide a flux path associated with a rotating magnetic field for inducing voltages in the primary coil; said system comprising a primary current circuit loop connecting the primary coil to an electronic switching means for making and breaking said circuit, an electronic control circuit connected across said primary coil and including impedance means selected to pass a portion of the current from said primary circuit loop, said control circuit including two branches, one branch including electronic switching components including a first capacitor for actuating said electronic switching means at a selected capacitor voltage, the second branch including an electronic switch means for controlling the feed rate therethrough as a function of current pulse frequency and including a second capacitor connected so that its reactance controls the feed rate through the second path whereby the rate of charging the first capacitor is controlled as a function of frequency of current pulses generated in response to changes in the speed of said rotating magnetic field.

6. A breakerless iginition system as set forth in claim 5 in which said one branch includes resistance-capcitance network interconnected by a transistor, the values of the resistor and capacitor and transfer resistance of the transistor being selected so that the voltage developed therein lags the primary voltage by a given phase angle, the values of the capacitor and transistor in said second branch being selected to control the feed rate of current flowing in said first branch whereby an ignition pulse is generated at the same edge distance for said ignition system.

* * * * *